US005142923A

United States Patent [19]

McKnight et al.

[11] Patent Number: 5,142,923

[45] Date of Patent: Sep. 1, 1992

[54] STARTER MOTOR WITH A PINION SEAL

[75] Inventors: Early C. McKnight, Columbus; James W. Gibson, Steens, both of Miss.

[73] Assignee: United Technologies Motor Systems, Inc., Columbus, Miss.

[21] Appl. No.: 386,827

[22] Filed: Jul. 27, 1989

[51] Int. Cl.[5] ..... F02N 15/06

[52] U.S. Cl. ..... 74/6; 74/7 A; 192/45; 123/179.1

[58] Field of Search ..... 74/6, 7 A, 7 C, 7 R; 192/45, 42; 123/179 C, 179 F, 179 K, 179 A

[56] References Cited

U.S. PATENT DOCUMENTS

| | | | |
|---|---|---|---|
| 1,486,919 | 3/1924 | Quinlan | 74/9 |
| 1,759,076 | 5/1930 | Whitnen | 74/6 |
| 2,287,669 | 6/1942 | Buxton | 74/7 B |
| 2,759,364 | 8/1956 | Lewis | 192/45 |
| 3,090,241 | 5/1963 | Mageoch et al. | 74/7 A |
| 3,460,655 | 7/1967 | Bowcott | 192/45 |
| 4,208,922 | 6/1980 | Mortensen | 74/7 R |
| 4,440,033 | 4/1984 | Kurihara et al. | 74/7 A |
| 4,718,290 | 1/1988 | Murata et al. | 74/7 A |
| 4,779,470 | 10/1988 | Morita et al. | 74/7 A X |

FOREIGN PATENT DOCUMENTS

| | | | |
|---|---|---|---|
| 0018823 | 1/1982 | Japan | 192/45 |

*Primary Examiner*—Leslie A. Braun
*Assistant Examiner*—Winnie Yip
*Attorney, Agent, or Firm*—Christopher T. Hayes

[57] ABSTRACT

The space between a pinion and starter case in an electric starter is sealed by a flexible disk. This disk rotates on the pinion. The pinion contains a circular slot for the disk, which has a central cut-out portion in the profile of the pinion teeth, which hold the disk in place in the slot once the disk is installed. The disk is installed by lightly forcing it over the teeth on the pinion. This seal blocks path for particulate and contaminants into the interior of the starter through the space between the pinion and the starter case.

2 Claims, 4 Drawing Sheets

STARTER MOTOR WITH A PINION SEAL

TECHNICAL FIELD

This invention relates to starter motors.

BACKGROUND OF THE INVENTION

In a typical electric starter motor, for instance, one for starting an automobile engine, there is a pinion that is moved into an engagement position on the engine flywheel. A particularly common starter of this type has an electrically operated solenoid to move a lever to slide a pinion assembly along the armature shaft, causing the pinion to engage the flywheel teeth. The pinion assembly normally consists of a clutch, its purpose being to prevent motor overloading and reverse driving when the engine starts.

The pinion assembly most typically moves within a cylindrical housing on the end of the starter housing; and part of this housing is cut-away area exposing the pinion gear. The engine flywheel extends into this cut-away portion, making it possible for the pinion gear to be moved into the position engaging the flywheel.

The opening in the housing for the flywheel provides a clear path for liquid, dust and particulate matter to the interior of the starter. Such contaminating materials ultimately cause premature wear of the electric motor, especially the bearings and commutator brushes. Specifically, contaminating material enters through the open annular space between the pinion assembly and the case. This contamination problem is especially serious when the electric starter motor is vertically oriented as are some starter motors. In this application, particulate easily settles on and around the pinion assembly. Because the pinion assembly moves abruptly, the particulate has a greater (natural) tendency to fall into the interior of the starter.

DISCLOSURE OF THE INVENTION

An object of the present invention is to provide a way to seal the interior of the starter motor.

According to the invention, the space between the pinion assembly and the case is sealed by a seal that moves with the assembly. According to the invention, a resilient plainar seal is located on the pinion assembly and fits in close proximity and effectively wipes along the cylindrical portion of the case in which the assembly moves. This seal, which may be made of a resilient plastic material, contains a cutout conforming congruently, but tightly, to the teeth on the pinion gear. The seal is placed (forced) over the teeth into a space behind the pinion gear. This space, which is annular, is between the pinion gear and the pinion gear housing (which contains the clutch mechanism). Once in this position, the seal can rotate freely on the pinion (on the same axis). Due to the tight fitting over the teeth on the seal, once it is placed, cannot accidentally come off. As the pinion gear is extended to engage the flywheel and is retracted from the engagement position with the flywheel, the seal has a continuous wiping contact with the case, preventing the entry of contaminants from the area outside at every possible pinion assembly position and also cleaning the wall of the case. The seal moves axially with the pinion and may rotate as the pinion rotates.

According to one aspect of the invention, the seal is circular and has a central portion that is thicker—less flexible—than an outer peripheral portion, which effectively "wipes" along the case wall, as the pinion (and pinion assembly) is extended and retracted along the shaft, providing a positive, long life seal.

BEST MODE FOR CARRYING OUT THE INVENTION

Figure 1:
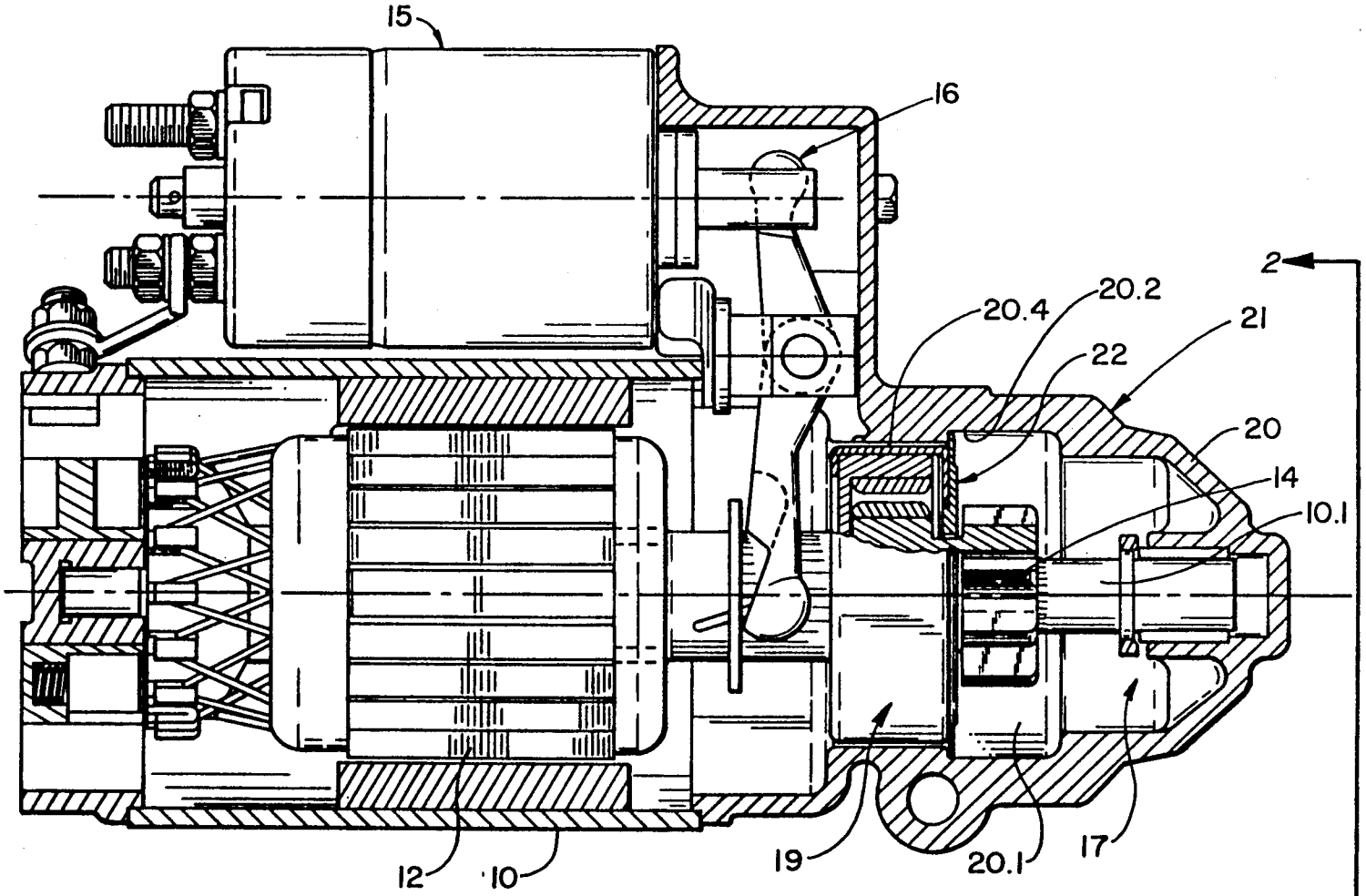
FIG. 1 is a cross-sectional view of an electric starter motor incorporating the present invention.

Referring to FIG. 1, an electric motor 10 contains an armature 12 which is used to rotate a pinion 14. On top of the motor is an electric solenoid 15, which is actuated to cause the movement of an actuating lever 16. This lever thrusts the pinion gear 14 towards the end 17 on the motor shaft. There the pinion would engage a flywheel (not shown). For the purposes of this discussion, it should be noted that the pinion 14 is actually part of a "pinion assembly" 19. This assembly includes a clutch mechanism (shown generally in FIG. 1 and in the partial cutout of the assembly FIG. 5) or other similarly functional components. These features protect the motor from overloading and overspeeding, and are known in the art.

It should be specifically observed in FIG. 1 that the pinion assembly moves within a generally dome-line portion 20 of the motor case 21.

Figure 2:
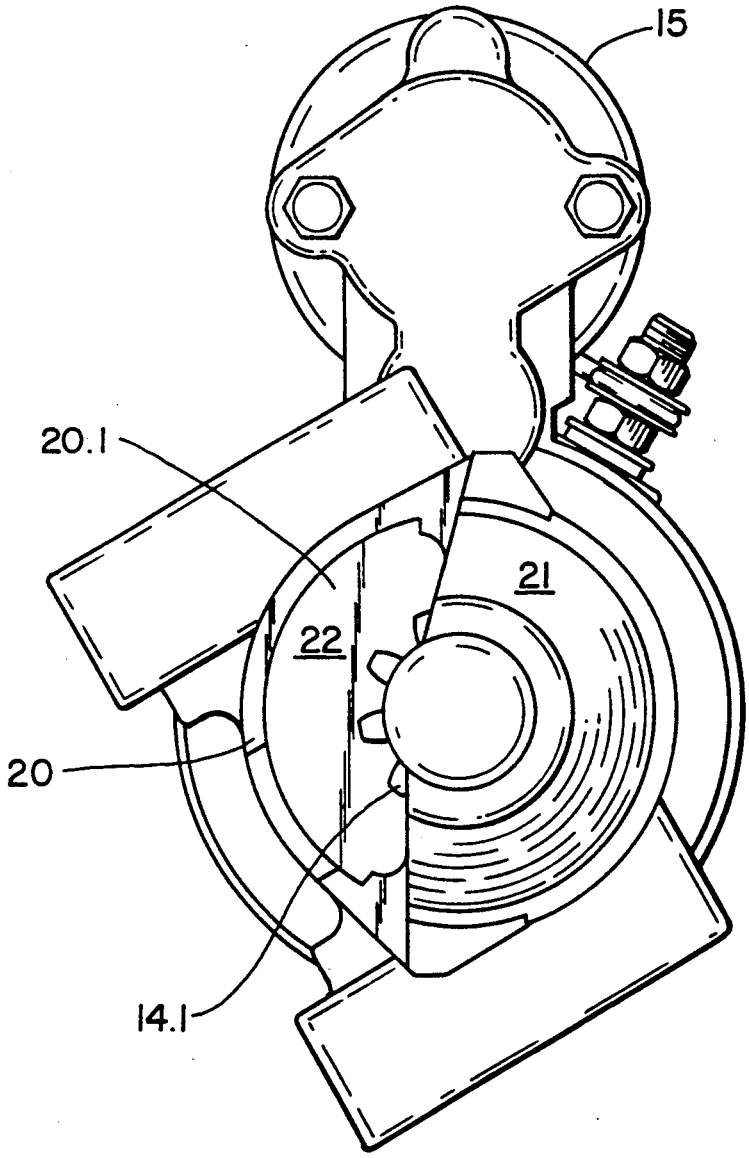
FIG. 2 is an end view looking in direction of arrows 2—2 in FIG. 1.

As FIG. 2 shows, the pinion dome 20 is cylindrical but contains a cutout portion 20.1 exposing a portion of the pinion gear teeth 14.1. Although it is not shown (it is well known), this portion 20.1 is cut out to receive the edge of an engine flywheel. The pinion, as noted earlier, is thrust towards the flywheel, and the teeth 14.1 engage the flywheel allowing the motor to rotate the flywheel as part of the engine starting procedure.

Figure 5:
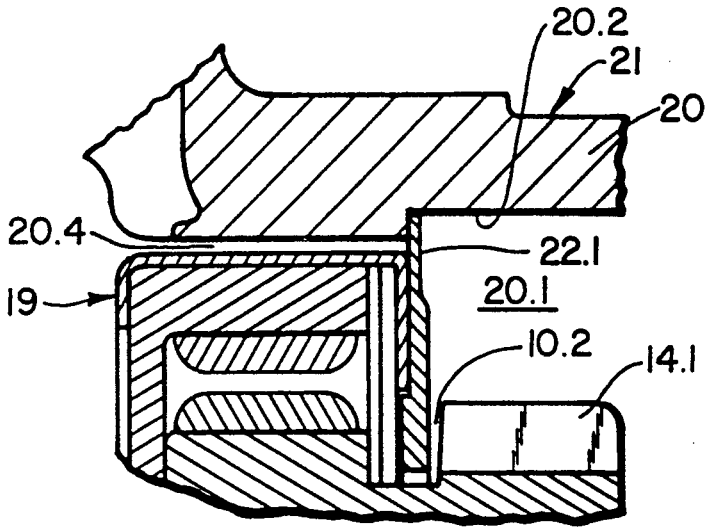
FIG. 5, an enlarged cross-sectional view of a portion of the starter in FIG. 1 shows a portion of the sealing disk (or ring) and the pinion gear and pinion assembly or carrier.

Referring back to FIG. 1, while also looking at FIG. 5, it should also be observed that located just behind the pinion gear 14 is a generally flat circular sealing disk 22. This sealing disk, which rotates on the axis of the motor shaft 10.1 and rests in an annular space 10.2 between the pinion and the pinion assembly. The disk rotates on a portion of the pinion assembly in that space 10.2.

As FIG. 5 shows in greater detail, that the extreme perimeter 22.1 of the sealing disk 22 is in close proximity to or contacts the inner wall 20.2 of the area 20.1, and through this contact the space 20.4 between the assembly and the case is sealed at all pinion positions.

Figure 3:
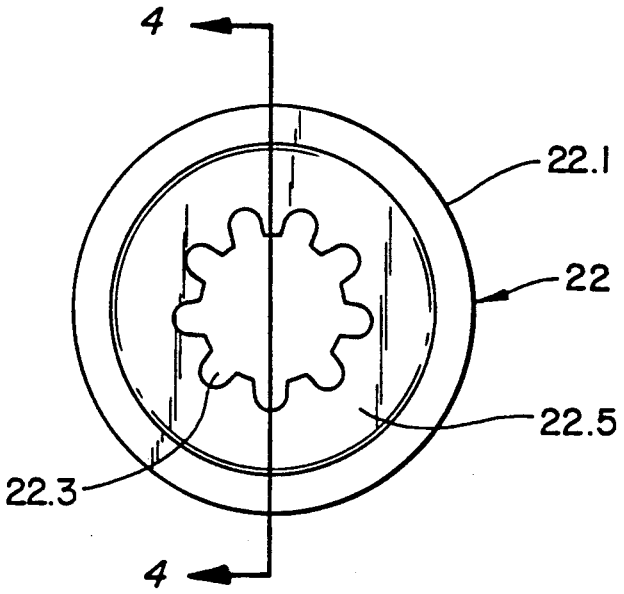
FIG. 3 is an elevational view of a sealing ring incorporating the present invention.
Figure 4:
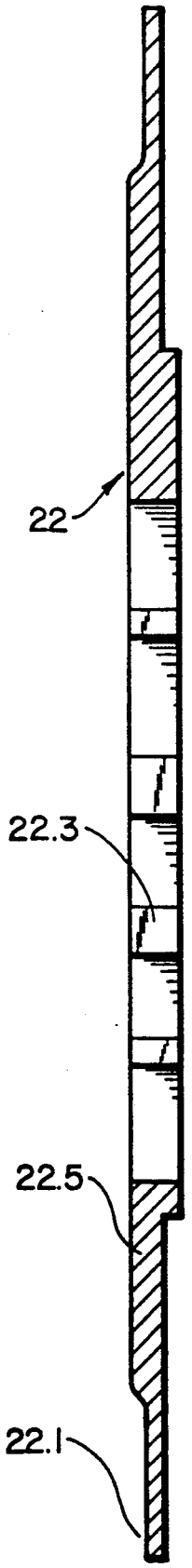
FIG. 4 is a section on line 4—4 in FIG. 3.

FIG. 3 shows this sealing disk in greater detail, and it should be observed there that the disk contains cutouts 22.3 tracing the pinion teeth pattern. In other words, the cut-out profile tightly matches the profile of the pinion 14. The disk 22 is forced onto the pinion and as a result it snaps into place behind the teeth, in area 10.2. FIG. 3 also shows that this disk has an inner portion 22.5. This portion is thicker than the outer portion 22.1, and the result is that the outer portion can flex and effectively "wipe" the wall 20.1 as it moves with the pinion 14. The central portion being thicker, is more rigid and does not flex nearly as much. The overall result is a tight seal.

Assembling the motor will involve forcing the disk 22 in place over the teeth 14.1 and then placing the pinion assembly on the motor shaft.

The disk seal should be made of a material that can resist heat and environmental conditions to which it will be exposed on an engine. It may be a plastic (polyurethane) or a neoprine material. Texin brand 455D polyurethane has been successfully used.

One skilled in the art, aided by this description, may make modifications and changes to the described embodiment of the invention without departing from its true scope and sport.

We claim:

1. An electric starter having a pinion that has teeth defining a profile and is axially movable in a pinion dome to engage a flywheel part of which extends into the pinion dome, there being a space between the pinion and an inner wall of the pinion dome and said pinion being rotatable on an axis, characterized by:

a seal for sealing said space, said seal comprising a circular disk that contacts said inner wall and contains a cut-out in said profile of the pinion teeth to fit tightly over teeth on the pinion, the seal being mounted and rotatable on the axis of said pinion and having its perimeter in close proximity to the inner wall of the pinion dome and being axially movable in synchronism with the pinion in the pinion dome when the pinion axially moves, wherein said pinion includes a circular space adjacent said teeth in which the disk rests.

2. The starter described in claim 1 characterized in that the disk has a central portion that is more rigid than an outer portion that contains said perimeter that is in close proximity to the inner wall.

* * * * *

UNITED STATES PATENT AND TRADEMARK OFFICE

CERTIFICATE OF CORRECTION

PATENT NO. : 5,142,923

DATED : September 1, 1992

INVENTOR(S) : Early C. McKnight et al

It is certified that error appears in the above-identified patent and that said Letters Patent is hereby corrected as shown below:

In column 3, at lines 16-17, delete "that has teeth defining a profile and", and insert --connected to a clutch mechanism having teeth defining a profile, said pinion--.

In column 4, at line 12, delete "adjacent", and insert --between the clutch mechanism and--.

In column 4, at line 17, change "close proximity to" to --contact with--.

Signed and Sealed this

Fifth Day of October, 1993

Bruce Lehman

*Attest:*

BRUCE LEHMAN

*Attesting Officer*

*Commissioner of Patents and Trademarks*